US005121515A

United States Patent [19]

Hudson

[11] Patent Number: 5,121,515

[45] Date of Patent: Jun. 16, 1992

[54] PILLOW

[76] Inventor: Gary C. Hudson, 4601 Sulgrave Rd., Richmond, Va. 23220

[21] Appl. No.: 777,592

[22] Filed: Oct. 16, 1991

Related U.S. Application Data

[63] Continuation-in-part of Ser. No. 719,976, Jun. 24, 1991, Pat. No. 5,061,737.

[51] Int. Cl.[5] ..... A47G 9/00; A47C 27/22

[52] U.S. Cl. ..... 5/636; 5/448; 5/481; 5/502; 5/926

[58] Field of Search ..... 5/434, 436, 481, 448, 5/502, 636, 901, 926; 297/DIG. 1; 428/317.9, 71, 327, 447

[56] References Cited

U.S. PATENT DOCUMENTS

| | | | |
|---|---|---|---|
| D. 317,236 | 6/1991 | Dixon | D6/601 |
| 3,287,750 | 11/1966 | Jessup | 5/481 |
| 3,394,414 | 7/1968 | Unger | 5/434 |
| 3,423,774 | 1/1969 | Streetman | 5/490 |
| 3,900,648 | 8/1975 | Smith | 5/481 |
| 4,021,871 | 5/1977 | Wortman | 5/434 |
| 4,184,237 | 1/1980 | Blankenship | 5/481 |
| 4,726,087 | 2/1988 | Scaefer et al. | 5/434 |
| 4,777,855 | 10/1988 | Cohen | 5/434 |

*Primary Examiner*—Alexander Grosz
*Attorney, Agent, or Firm*—Kenway & Crowley

[57] ABSTRACT

A pillow comprising a container made of edge-joined slabs of polyurethane foam filled with a mixture of polyurethane foam chips averaging about one-quarter inch square and polyester fibers averaging about two inches in length, said fibers being coated with silicone, said mixture being homogeneous and consisting of 70 to 50 percent of said polyurethane foam chips and 30 to 50 percent of said coated polyester fiber.

2 Claims, 1 Drawing Sheet

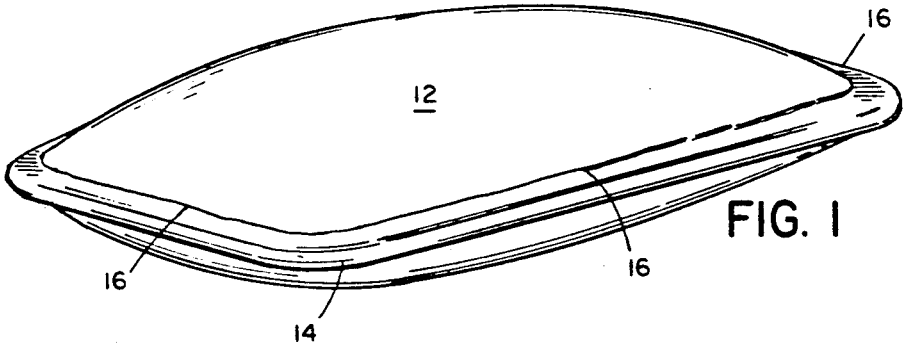
FIG. 1
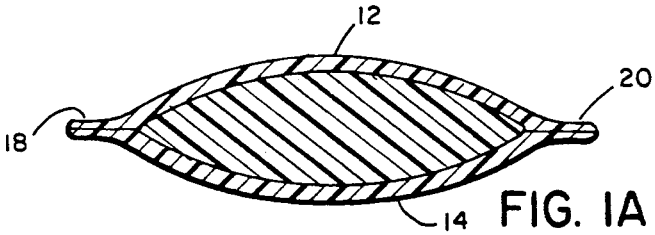
FIG. 1A
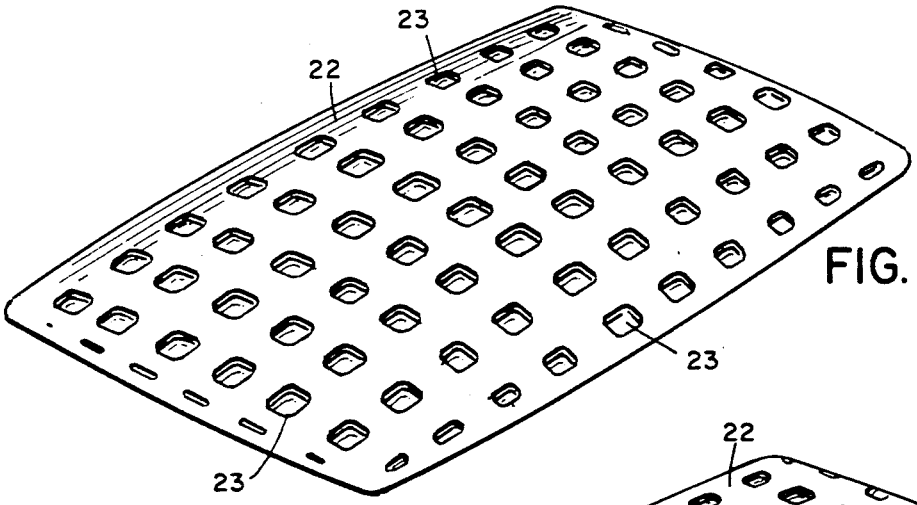
FIG. 2
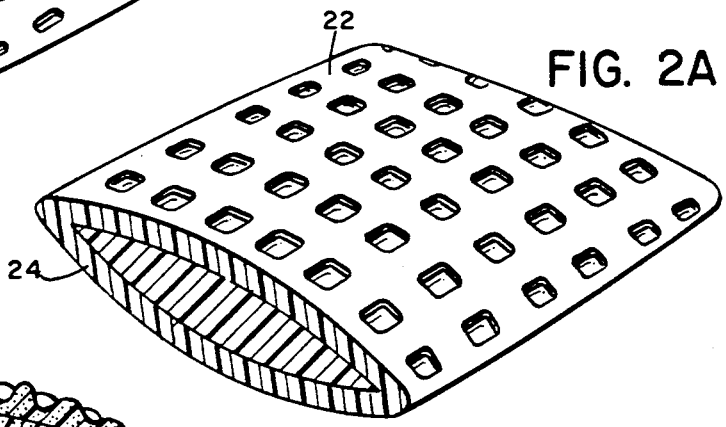
FIG. 2A
FIG. 3
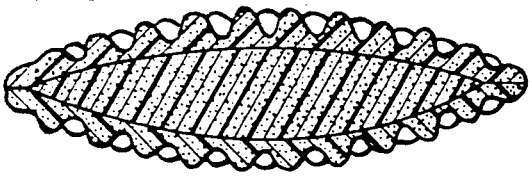

PILLOW

This application is a continuation-in-part of U.S. Ser. No. 07/719,976 filed Jun. 24, 1991 now U.S. Pat. No. 5,061,737 for Filling Material.

In the pending parent application, there is disclosed filling material for packing or padding pillows, cushions, upholstery, or the like, or for use as a thermal insulation or packing material. The present invention relates to a pillow or like article in which the filling material of the cited application may be used.

BACKGROUND OF THE INVENTION

Filling material, especially for pillows, should be lightweight, resilient and flexible, so that it retains its shape and does not become flattened or crushed permanently. It should be soft to provide comfort when used as a head rest, but it should retain its shape so that the filling does not move to one end or the other. It is also desirable that it should be easily cleaned and that it should not deteriorate rapidly with age.

Natural materials such as down, cotton wadding or batting, kapok, horsehair, tow batting and the like have been used in the past for such filling materials, but are now being replaced by latex and synthetics. Flexible foam materials such as foam latex and foam polyurethane have many advantages. However, they do not have the comfort or luxury of down and are unsuitable for thermal insulation. They are also expensive since the material required to fill a given volume is relatively great.

Another much-used filling material, particularly for the cores of pillows, is composed of fibers. Polyester fibers are especially popular, even though they tend to bunch up and create pockets which permit the pillow to "bottom out".

Some efforts have been made to combine foam pieces with fibers, but these tend to "clump" together as the foam pieces become entangled with the fibers. These efforts culminated in the filling material of the cited application which is created by shredding polyethylene foam of a predetermined density and indent load deflection into chips or roughly square blocks of about average of one-quarter (¼) inch square. The foam chips may be collected in a bag after shredding and fed into a hopper.

At the same time, polyester fiber composed of any fiber-forming substance which is a long-chain synthetic polymer is prepared. Fibers coated or slickened with a finish such as silicone and of average length of about 2 inches are prepared and then mixed in a tumbler with the foam in an average ratio of 60% foam to 40% fiber. The resultant product is a homogeneous fiber-foam filling material which performs well as a pillow core, or as a filler for comforters, cushions and upholstered items result.

The density of the starting foam material is not critical, but foam of a density of 0.8 to 1.3 lbs. per square foot and an indent load deflection (ILD) of 8 to 20 lbs. has proven satisfactory. The ILD of such polyurethane foam is defined as the amount of weight required to reduce a square block of foam of 16"×16"×4" thickness down to a thickness of 3". Such foam has been commonly used alone with no other materials as filler for pillows in ranges of 0.8 to 1.2 lbs. density and an ILD of about 10 lbs.

The foam is then shredded into chips or roughly square blocks of about one-eighth to one-half inch per side. Desirably, the average chip or block is about one-quarter inch square. The shredding is accomplished in a conventional foam shredding machine, the foam chips are collected in a bag and placed in a hopper.

Polyester fiber is prepared at the same time. The fiber-forming material may be any long-chain, non-cellulosic synthetic polymer. The fibers should have certain qualities, including crease resistance, quick-drying capabilities, shape retention, high strength and abrasion resistance.

As to size of the fiber, that is not critical, but 5 to 15 denier, averaging about 6 denier for use with the average quarter-inch foam chips, has performed well. Finally, the fiber should be coated or slickened with a finish such as silicone. In addition to enhancing washability, resilience, and durability, the slickened fibers are capable of limited movement relative to themselves and to the foam chips.

For use with the average quarter-inch foam chips, fiber of 1.25 to 3 inches in length, averaging about 2 inches, has proven superior. The fibers are mixed with the foam chips in a ratio of 30% to 50% fiber to 70% to 50% foam (averaging 60% foam to 40% fiber) in a tumbler to produce a homogenous fiber-foam material for filling pillow cores, comforters, upholstered items and the like. The length and denier of the fibers relative to the size of the chips plus the limited movement facilitated by the slickened surface of the fiber affords the user a feeling of comfort while maintaining shape and providing adequate support.

Fiber suitable to be prepared for use in the invention is available commercially under various trade names, such as FILWELL II, which is a solid polyester fiber of 6 and 15 denier slickened with silicone, or FILWELL III, which is a hollow polyester fiber of 6, 8, 12 and 15 denier slickened with a silicone coating. The manufacturer of these fibers is Wellman, Inc. of Johnsonville, S.C. Similar fibers are available from several manufacturers, including E.I. duPont de Nemours & Co. of Wilmington, Del.

Although the filling material of the invention permits the making of superior pillows and other cushioning articles, there has not been available a casing of sufficient quality to bring out to the fullest the inherent advantages of the new filling material. In fact, the commonly used casing is made of ticking which may be made of linen, canvas, or other rugged but relatively thin fabric.

It is therefore a primary object of the present invention to provide a pillow having a casing which includes a pouch of relatively soft material having a predetermined surface texture.

It is a further object of the present invention to produce a pillow which includes a resilient casing and a fiber/foam filling material which does not "bottom out".

Another object is to provide a casing or pouch made of foam which can be economically and easily made to form pillows of various sizes.

Still another object is to provide a foam pouch for a pillow which can be made by stitching, heat-sealing, or cementing.

Yet another object is to provide a pillow having a casing which may be formed using convoluted layers of foam compressed and severed in predetermined patterns.

These and other objects of the present invention may be attained by following the teaching of the invention as exemplified by the following description of preferred embodiments of the invention in which:

FIG. 1 is a perspective view of a foam pouch for a pillow in the process of manufacture;

FIG. 1(*a*) is a cut-away view of the pillow of FIG. 1.

FIG. 2 is a perspective view of a surface of a pillow in the process of manufacture convoluted to provide an ULTIMAT® surface;

FIG. 2(*a*) is a cut-away sectional view of a pillow incorporating surfaces as shown in FIG. 2; and FIG. 3 is a cut-away perspective view of a pillow having convoluted EGG-CRATE® surfaces.

SUMMARY OF THE INVENTION

Filling material for the pillows or cushioning articles of the invention is formed in accordance with the teaching of the above-identified application Ser. No. 07/719,976, now U.S. Pat. No. 5,061,737 which was filed by Gary C. Hudson, the applicant herein. The casing of the pillow in its simplest form is made by edge-sealing two layers of foam about their peripheries to form a pouch of elliptical central cross-section which may be tapered to be sealed at their ends. Two flat slabs of foam from about ½" to 2" thick may be edge-joined together along two sides and an end, after which filling material is inserted. Alternatively, the peripheries may be heat-sealed, cemented or sewn together to form the open-ended pouch, and the open end may be closed after the filling material is inserted.

In more elaborate configurations, the pillow case or pouch may be made up of convoluted foam slabs, each slab being of approximately 1" to ½ in thickness. The convoluting treatment of the slabs to produce so-called EGGCRATE® or ULTIMAT® surfaces may be generally in accordance with the teaching of U.S. Pat. No. 4,603,445 issued Aug. 5, 1986, and the closed pouch may finally be inserted in a pillow case made of ticking.

DESCRIPTION OF PREFERRED EMBODIMENT

In FIG. 1, the invention is shown in its simplest form. Two similar slabs of polyurethane foam 12 and 14, preferably from ½" to 2" in thickness, are sewn or heat-sealed together at their edges as indicated at 16, but leaving one end open. These slabs are so formed and joined as to form a pouch of roughly elliptical cross-section as shown in FIG. 1A. It may be desirable to taper the edges which are joined, although that is not necessary. Also, the pouch may then desirably be turned inside out to leave rough edges inside the pouch and smooth rounded edges on the outside.

The elliptical cross-section is achieved by maintaining the spacing between the joined edges 18 and 20 at a dimension shorter than the width of the separate slabs 12 and 14, respectively. Similar provisions may be made along the length of the foam slabs.

In actually fabricating the pillow, the open-ended container is first formed, and then a fiber/foam combination of the type disclosed in U.S. patent application Ser. No. 07/719,976 now U.S. Pat. No. 5,061,737 is blown in. The weight of the inserted combination of coated fibers mixed with foam chips may be adjusted to provide a fullness dictated by the specification of the final product. After the container is filled, the remaining open end may be stitched or heat-sealed in the same fashion as the other three joined edges. Depending upon the requirements of the final product, stitching of the container edges or heat-sealing of a pouch for a pillow may be preferred. In the pillow, the filled and sealed pouch may be inserted in an outer casing of pillow ticking which has a zippered or other closable opening.

In FIG. 2, there is shown a surface of a foam slab 22 which has been given a convoluting treatment. In that treatment, slabs of polyurethane foam are compressed in a machine of the type made and sold commercially by Edge Sweets, Inc. of Grand Rapids, Mich. as Model No. M-60 RSS&C. Two slabs of foam of minimum thickness of about 1¼" each are placed between counter-rotating rollers which have intermeshing radially extending shaped hammers. The machine also includes a saw blade, and material to be processed is fed into the bite of the rollers where it is compressed and the saw blade cuts through the foam on a plane parallel to the flat surface of the foam slabs, which severs the peaks of foam formed by and about the hammers. The foam is permitted to expand to its original width, and when the severed peaks are removed, deep openings relative to the thickness of the foam blocks are formed. This process and equipment are more fully illustrated and described in U.S. Pat. No. 4,603,445.

The slab 22 shown in FIG. 2, after convoluting has taken place, has openings 23 uniformly disposed over its surface. A similar convoluted slab 24 is joined to the slab 22 by edge sewing or heat sealing as partially shown in the cut-away view of FIG. 2A, and the pouch so formed is filled with the fiber/foam filling material described hereinabove, preferably by blowing the filling material into the pouch. After filling, the open end is stitched or heat-sealed to join the two slabs. The foam pouch filled with fiber/foam filling material may then be inserted in suitable pillow ticking, preferably having a zippered opening or an opening which can be stitched or sealed closed.

Other surface configurations may be utilized in fabricating the foam pouch of the present invention. In FIG. 3, a common foam surface known as EGG-CRATE® is typical of those which are useful is shown. An EGG-CRATE® surface may be formed utilizing single foam slabs in a convoluting machine in much the same manner as the ULTIMAT® surface is formed, and the peaks of the protrusions above the top slab surface should be at about one-half the dimension between the top and bottom surfaces of the slab. The thickness of the slab from the bottom surface to the base of the peaks should be ½" to 1", although this is not critical.

Pillows formed in the manner described rate very high in terms of comfort and can be made at relatively low cost. The combination of fiber/foam filling and foam pouch enhances synergistically the comfort provided by each feature, and the use of EGG-CRATE® or ULTIMAT® surfaces permits air circulation which lends a feeling of coolness to the pillow. Of course, the invention may also be incorporated in other items such as mattresses, cushions, pads, comforters, or the like.

What is claimed is:

1. A pillow comprising a container made of edge-joined slabs of polyurethane foam filled with a mixture of polyurethane foam chips averaging about one-quarter inch square and polyester fibers averaging about two inches in length, said fibers being coated with silicone said mixture being homogeneous and consisting of 70 to 50 percent of said polyurethane foam chips and 30 to 50 percent of said coated polyester fiber.

2. A pillow or the like as defined in claim 1 wherein said edge-joined foam slabs have outwardly facing convoluted surfaces.

* * * * *